United States Patent [19]

Smirnov et al.

[11] 3,977,192

[45] Aug. 31, 1976

[54] HYDRAULIC DRIVE PULSATOR OF RECIPROCATING ACTION

[76] Inventors: Igor Nikolaevich Smirnov, ulitsa Narodnogo opolchenia, 10, kv. 363; Mikhail Ivanovich Semenov, Pokrovsky bulvar, 8, kv. 13, both of Moscow; Nikolai Vasilievich Zjuzenko, ulitsa Merkelya, 17, kv. 2, Riga; Vitaly Andreevich Sergeev, Konkovo-Derevlevo, Mikroraion 6, dom 26, korpus V, kv. 281, Moscow, all of U.S.S.R.

[22] Filed: Oct. 18, 1972

[21] Appl. No.: 298,630

[52] U.S. Cl. ..... 60/543; 417/383; 60/591

[51] Int. Cl.[2] ..... F15B 7/02

[58] Field of Search ..... 60/54.5 R, 54.6 R, 537, 60/539, 543, 583, 591; 417/387, 388, 514, 383, 385

[56] References Cited

UNITED STATES PATENTS

| | | | |
|---|---|---|---|
| 2,046,491 | 7/1936 | Scott | 417/387 |
| 2,676,464 | 4/1954 | Warren | 60/543 |
| 2,843,044 | 7/1958 | Mashinter | 417/383 |
| 2,848,878 | 8/1958 | Schnell | 60/54.6 R |
| 3,050,945 | 8/1962 | Maynard | 60/555 |
| 3,496,875 | 2/1970 | Van Allen et al. | 417/388 |
| 3,583,159 | 6/1971 | Paulet | 60/54.5 R |

FOREIGN PATENTS OR APPLICATIONS

| | | | |
|---|---|---|---|
| 439,980 | 10/1948 | Italy | 4/388 |
| 272,374 | 6/1927 | United Kingdom | 417/385 |

*Primary Examiner*—Martin P. Schwadron
*Assistant Examiner*—H. Burks, Sr.
*Attorney, Agent, or Firm*—Haseltine, Lake & Waters

[57] ABSTRACT

A chamber of an actuating mechanism is hydraulically connected to the under-the-piston cavity of the cylinder adjacent to the housing of a pulsator. Built into the piston is a spring-loaded valve serving as a device for compensating for the leakage of liquid from the chamber and for protecting the latter against overload pressure. During the operating stroke of the piston, the valve is brought in contact with it by an eccentric, and in case the pressure is increased or it is necessary to compensate for the leakage of liquid, a clearance is formed between the valve and the piston for the liquid to pass the direction of the liquid flow being dependent on the pressure differential on the valve.

4 Claims, 3 Drawing Figures

HYDRAULIC DRIVE PULSATOR OF RECIPROCATING ACTION

BACKGROUND OF THE INVENTION

The present invention relates to the field of pump building, and more particularly, to hydraulic drive pulsators of reciprocating action.

The invention is mostly applicable to the production of diaphragm pumps with a hydraulic drive of the diaphragm and of hydraulic drives for obtaining precise reciprocating movements.

As is known to those skilled in the art, there are hydraulic drive pulsators of reciprocating action. For example, use is made of pulsators of reciprocating action for diaphragm hydraulic drives in the diaphragm pumps.

The pulsators of known designs comprise a housing with a cavity filled with liquid and communicating with the cavity of the cylinder adjacent to the housing located wherein is a spring-loaded piston set in reciprocating motion by an eccentric fastened to the driving shaft of the pulsator located in the cavity of the housing, with the cylinder cavity under the piston being hydraulically connected to the chamber of the actuating mechanism incorporating a device compensating for the liquid leakage therefrom and protecting it against pressure overloads.

In known pulsators the system for maintaining a constant amount of liquid and its pressure in the chamber of the actuating mechanism consists of two spring-loaded valves, viz. a filling or a relief valve and a safety valve. These valves actuate when acted upon by a certain pressure differential. The value of the pressure differential is established by adjusting their springs. This operation requires highly-skilled personnel and it is difficult to be performed under service conditions.

Besides. no valves are absolutely liquid-tight, i.e. they allow for some amount of liquid to leak, therefore, any of the mentioned valves is a source of varying the constant amount of liquid in the chamber of the actuating mechanism, thus reducing the efficiency and the reliability of the pulsator operation, as well as the accuracy in maintaining the preset pulsating consumption of liquid.

The object of the present invention is to overcome the mentioned disadvantages and to provide a more reliable and efficient design of a reciprocating hydraulic drive pulsator.

SUMMARY OF THE INVENTION

This object is attained in the hydraulic drive pulsator of reciprocating action, comprising a housing with a cavity filled with liquid and communicating with the cavity of the cylinder adjacent to the housing. Located therein is a spring-loaded piston set in reciprocating motion by an eccentric fastened to the driving shaft of the pulsator located in the cavity of the housing, with the cylinder cavity under the piston being hydraulically connected to the chamber of the actuating mechanism, and incorporating a device for compensating for the leakage of liquid and protecting the chamber against pressure overloads.

According to the invention, the device for compensating for the leakage of liquid and for protecting the chamber of the actuating mechanism against pressure overloads comprises a spring-loaded valve built into the axial opening of the piston, the valve being in contact with it during the operating stroke of the piston whose effective area is smaller than the area confined by its line of contact with the valve, and which forms with the piston a clearance for the liquid to pass while compensating for its leakage from the chamber of the actuating mechanism and when the pressure increases in it.

Thus the spring-loaded valve serves both as a safety valve and as a relief valve.

It is advisable that the ratio between the effective area of the piston and the area confined by its line of contact with the valve be within 0.99 – 0.66.

A further increase in the area difference of the piston and the spring-loaded valve leads to an increase in the non-uniformed distribution of the load over the drive gear.

It is also expedient for the spring-loaded valve to have a limiter restricting its movement with respect to the piston, the limiter being constructed in the form of a pin installed in the opening of the valve perpendicular to its longitudinal axis and moving in the slots made in the walls of the piston parallel to it's generatrix.

In the disclosed design, one spring-loaded valve serves both as a relief valve and as a safety valve, thus reducing the leakage of liquid from the chamber of the actuating mechanism and increasing the reliability of operation of the pulsator in general.

A detailed description of the construction of a pulsator and its operation is given below with reference to the accompanying drawings.

DESCRIPTION OF THE PREFERRED EMBODIMENTS

Figure 1:
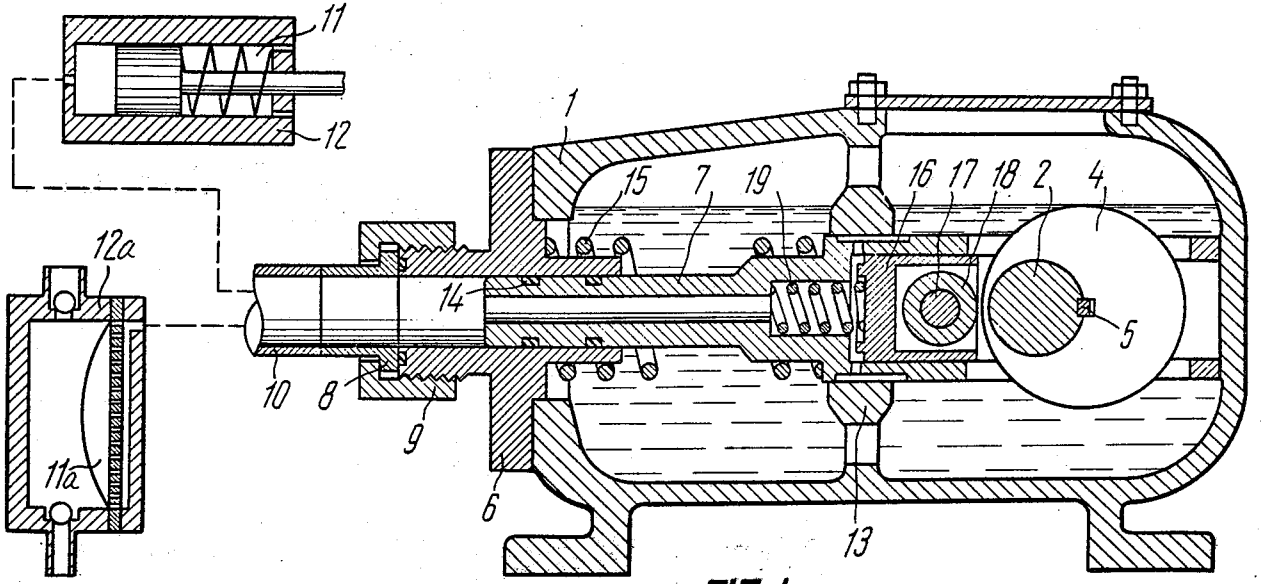
FIG. 1 is a general view with longitudinal cross-section of hydraulic drive pulsator of reciprocating action.

The housing 1 (FIG. 1) of the proposed pulsator is a cast workpiece incorporating an inner cavity confined by the walls of the housing 1.

A hole is made in the side wall of the housing 1 for the driving shaft 2 to pass through, the latter being installed on the radial bearings 3 located in the bores of the side walls of the housing 1.

Mounted on the driving shaft 2 on the outside of the housing 1 is a clutch (not shown in the drawing) through which the rotation of the motor (not shown in the drawing) is transmitted to the driving shaft 2.

Inside the housing 1 the driving shaft 2 is provided with an eccentric 4 locked by the key 5 against rotation with respect to the driving shaft 2.

Made in the left-hand wall (cf. the drawing) of the housing 1 is cylindrical bore whose axis is perpendicular to the axis of the driving shaft 2.

Fixed in the bore is the cylinder 6 fastened to the outside of the housing 1 by means of pins and nuts. The cylinder 6 is provided with an inner cavity having a piston 7 therein. The under-the-piston cavity of the cylinder 6 is connected to the chamber 11 of the actuating mechanism 12 by means of the nipple 8 with the union nut 9 and the pipeline 10.

To serve as such an actuating mechanism use is made, for example, of the power cylinder piston of a hydraulic press or the diaphragm 11*a* of a pump 12*a*, etc.

An inner partition 13 is provided in the cavity of the housing 1, having a cylindrical bore which is coaxial with the inner cavity of the cylinder 6 and serves as guide for the piston 7.

The piston 7 is made in the form of a stepped-up cylinder.

On the smaller diameter of the piston entering the cavity of the cylinder 6 there are circular grooves with sealing rings 14 installed thereof, effecting the sealing of the cavity of the cylinder 6.

The medium diameter of the piston 7 serves as a guide for the spring 15 which is pressed with one end against the wall of the cylinder 6, and with the other end against the butt formed on the piston 7 at the transition point from the medium diameter to the maximum diameter. The spring 15 is used to return the piston 7 to the initial position.

The surface of the maximum diameter of the piston 7 is located in a cylindrical bore made in the partition 13 of the housing 1. A through stepped-up cylindrical hole is bored in the piston 7. Located in the larger diameter bore of the piston 7 is the valve 16 constructed in the form of a cylinder.

Bored along the diameter of the body of the valve 16 is a through hole with the pin 17 located therein, serving as an axle of the roller 18 for which there is provided a slot in the body of the piston 16.

The length of the pin 17 is larger than the diameter of the valve 16, and the ends of the pin 17 enter the slots formed in the walls of the piston 7 parallel to its generatrix. The length of the slots is equal to the sum of values of the diameter of the pin 17 and the travel of the valve 16. Thus, the pin 17, moving in the slots of the piston 7, serves as a limiter restricting the movement of the valve 16.

The left-hand (cf. the drawing) end of the valve 16 is sealed in by circular sealing belt.

The end area of the valve 16 confined by the sealing belt is selected larger than the effective area of the piston 7.

The spring 19 is pressed against the end of the valve 16 where the sealing belt is formed, the other end of the spring being pressed against the transitional area of the through cylindrical bore in the piston 7 from the small diameter to the medium diameter.

In the wall of the piston 7 on the section with the largest diameter through slots are formed for the driving shaft 2 and the eccentric 4 to pass.

Figure 3:
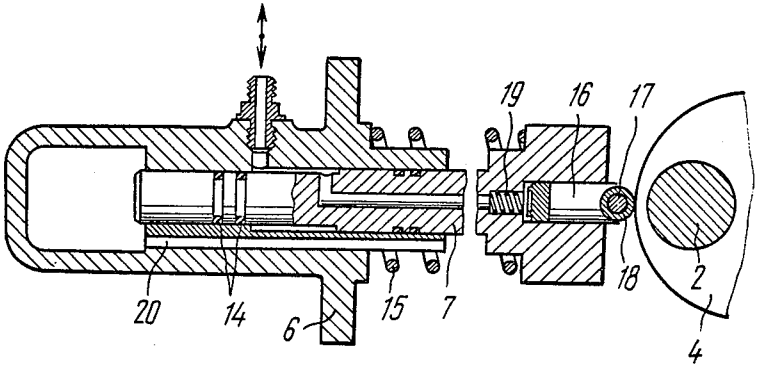
FIG. 3 is a general view with longitudinal cross-section of an embodiment of the hydraulic drive pulsator of reciprocating action.
Figure 2:
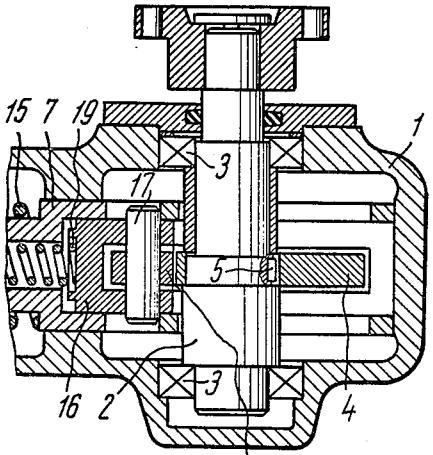
FIG. 2 is a top view of the same.

If it is required to obtain small pulsating supplies, the diameter of the piston 7 should be comparatively small, therefore, it is difficult to bore a through stepped-up hole in it. The piston 7 (FIG. 3) has a stepped-up form. The cavity of the cylinder 6 has also a stepped-up form, being provided with a hole 20 communicating the cavity of the cylinder 6 with the cavity of the housing 1.

The chamber 11 of the actuating mechanism 12 therewith is connected to the pipeline 10 whose cavity is confined by the small diameter of the piston 7 and the side walls of the cylinder 6.

The pulsator operates in the following manner.

Prior to starting operation, the cavity of the housing 1 and the cavity of the cylinder 6 communicating therebetween are filled with a liquid, for example, mineral oil.

The driving shaft 2 is set in motion by a motor of any type through a clutch.

The eccentric 4 located on the shaft 2, while rotating, is brought in contact with the roller 18 disposed on the pin 17 rigidly connected with the valve 16 and moves the valve 16 with respect to the piston 7 compressing the spring 19.

The valve 16 continues to move until the sealing belt on its end touches the surface of the transitional diameter in the piston 7 and blocks the axial hole in it, this being followed by a mutual movement of the valve 16 and the piston 7, compressing the spring 15 thereby. The valve 16 blocking the hole in the piston 7 seals the cavity of the cylinder 6, transmitting the movement of the piston 7 to the actuating mechanism 12 via the liquid filling the cavity of the cylinder 6.

The reverse stroke of the piston 7 is effected by the spring 15. The piston 7 moves together with the valve 16 until the piston 7 comes to rest against the cavity wall of the housing 1 opposite the cylinder 6. Then the piston 7 stops, and the valve 16 continues to move under the effect of the spring 19. As this is done, a clearance connecting the cavity of the housing 1 with the cavity of the cylinder 6 is formed between the end of the valve 16 and the piston 7.

If during the operating stroke of the piston 7 the liquid has leaked from the cavity of the cylinder 6 via the sealing rings 14 or the valve 16, the liquid from the cavity of the housing 1 passes to the cavity of the cylinder 6 as soon as the clearance has been formed, thus compensating for the leakage of the liquid.

When the pressure of the liquid rises in the chamber 11 of the actuating mechanism 12 exceeding the preset value, the spring 15 compresses, further forming a clearance between the valve 16 and the piston 7 through which the liquid passes from the cavity of the cylinder 6 into the cavity of the housing 1.

Springs 15 and 19 apply forces against the piston 7 only when pressure above atmospheric does not prevail within the cavity of the cylinder 6. The springs 15 and 19 press against the valve 16 and cause it, thereby to move towards the right when viewing FIG. 1.

Pressure is relieved when the valve 16 is pressed against the piston 7 by cam 4. The pressure is relieved through a clearance defined between the piston 7 and the valve 16. The pressure is relieved by the discharge of liquid through this clearance from the space of the cylinder 6 to the cavity of the housing 1. The pressure level in the cavity of the cylinder 6, at which the clearance develops between the valve 16 and the piston 7, is determined by the ratio of the difference between the forces of the springs 15 and 19, to the difference between the area defined between the valve 16 and the piston 7, and the effective area of the piston 7.

An opening is created when the piston moves to the left, and this opening is in the form of the clearance defined above. Such a clearance is substantially such a small-dimensioned space, that it is not possible to show it in the drawing, since the depth of that space constitutes substantially the thickness of a line in the drawing.

The principle of limiting the pressure is explained by the following considerations.

Considering the balance of forces from the liquid in the under-the-piston cavity of the cylinder 6, acting on the piston 7, we obtain:

$$F_A = F_1 + f_1 \cdot P_2,$$

where, $F_A$ = effort exerted by the pressure of liquid on the piston 7 from under-the-piston cavity of the cylinder 6;

$F_1$ = effort of the spring 15;
$f_1$ = effective area of the piston 7;
$P_2$ = pressure of liquid in the cavity of the cylinder 6.

$$F_B = F_2 + f_2P_2,$$

where, $F_B$ = effort exerted by the pressure of liquid on the piston 7 from the valve 16;
$F_2$ = effort of the spring 19;
$f_2$ = area of the valve 16 confined by its line of contact with the piston 7.

If $F_1 > F_B$, the balance of forces is restored by the mechanical effort exerted on the piston 7 from the valve 16 set in motion by the eccentric 4.

If $F_A < F_B$, the balance of forces is upset, and, being effected by the difference of forces, the piston 7 speeds up its movement, leaving the valve 16 behind. A clearance is formed between them through which the liquid passes from the cavity of the cylinder 6 into the cavity of the housing 1.

This effect is possible only if $f_2 > f_1$, since only under this condition, with the pressure $P_2$ rising in the cavity of the cylinder 6, the effort $F_B$ exerted from the valve 16 on the piston 7 increases quicker than the effort $F_A$ exerted on the piston from the cavity of the cylinder 6.

The value of the pressure $P_2$ of the liquid in the cavity of the cylinder 6 corresponding to the opening of the valve 16 at a definite ratio between the areas $f_1$ and $f_2$ of the piston 7 and the valve 16 respectively, and the effort $F_2$ of the spring 19, is determined by the effort $F_1$ of the spring 15.

To provide normal operation of the pulsator, it is necessary for the piston 7 to start its movement following the closing of the valve 16; therefore, the effort $F_1$ of the spring 15 should be larger than the effort $F_2$ of the spring 19.

Taking into account that an increase in the difference of the areas $f_1$ and $f_2$ of the piston 7 and the valve 16 respectively, entails an increase in the effort of the spring 15, and, consequently, an increase in the power consumption and the irregularity of pressure distribution over the eccentric 4 and the shaft 2, it is expedient to confine the ratio of the mentioned areas to the range of 0.99 – 0.66.

In the disclosed pulsator the valve 16 serves both as a relief valve and a safety valve, thus considerably reducing the dimensions of the pulsator and increasing the reliability of its operation.

What is claimed is:

1. A hydraulic drive pulsator with actuating mechanism and reciprocating action, comprising: a housing with a cavity filled with liquid, a cylinder adjacent to the said housing; a cavity in the said cylinder communicating with the cavity of the said housing; a spring-loaded piston located in the cavity of the said cylinder and separating said cylinder from the space of said housing; a driving shaft of the said pulsator located in the cavity of the said housing; an eccentric fastened to the said driving shaft, said piston being set in reciprocating motion by the said eccentric; an axial hole bored in the said spring-loaded piston; a third chamber of said actuating mechanism with a device for compensating for the leakage of the liquid therefrom and for protecting said third chamber against overload pressure, said device comprising: a spring-loaded valve built into said hole of said piston so that during the operating stroke of the said piston said valve is brought into contact with said piston, said device while compensating for the leakage of liquid from the said third chamber or increasing the pressure therein, forming with said piston a clearance for the liquid to pass, the effective area of the said piston being smaller than the area confined by the line of its contact with said valve.

2. A hydraulic drive pulsator with actuating mechanism and reciprocating action, according to claim 1, wherein the ratio between the effective area of said piston and the area confined by the line of its contact with said valve is maintained in the range of 0.99 –0.66.

3. A hydraulic drive pulsator with actuating mechanism and reciprocating action, according to claim 1, wherein said spring-loaded valve includes a limiter restricting its movement with respect to the piston, said limiter being in the form of a pin installed in a hole bored in said valve perpendicular to its axis and moving in slots in the walls of said piston parallel to its generatrix.

4. A hydraulic drive pulsator with actuating mechanism and reciprocating action, comprising: a housing with a cavity filled with liquid, a cylinder connected to said housing; a cavity in the said cylinder communicating with the cavity of the said housing; a spring-loaded piston located in the cavity of the said cylinder and separating said cylinder cavity from the cavity of said housing; a driving shaft of the said pulsator located in the cavity of the said housing, an eccentric fastened to the said driving shaft for contacting said piston during rotary motion of said driving shaft, said piston being set in reciprocating motion by periodic contact from said eccentric when rotated by said shaft, an axial stepwise hole in the said spring-loaded piston having maximum, minimum and intermediate cross-sectional areas; a chamber of said actuating mechanism with a device for compensating for the leakage of the liquid therefrom and for protecting said chamber against overload pressure, said device comprising: a valve in said hole of said piston and within the maximum cross-sectional area for reciprocating along the piston axis; a spring in said hole in said piston within the intermediate cross-sectional area and abutting with one end against said valve, the other end of said spring abutting against the step of the hole between the intermediate and minimum cross-sectional areas, respectively said step being formed by the surface between said intermediate and minimum cross-sectional areas; said valve having on its end face, on the side facing said step of said hole between the maximum and the intermediate cross-sectional areas, an annular projection contacting the plane of said step; said piston having an effective area smaller than that of said valve and limited by the line of contact between its annular projection and said step of said hole in said piston.

* * * * *